United States Patent [19]

Roces

[11] 4,112,681

[45] Sep. 12, 1978

[54] HYDRAULIC COUPLING AND SPEED MULTIPLYING MECHANISM

[76] Inventor: Rafael Tuti Roces, 1646-C F. Agoncillo St., Ermita, Manila, Philippines

[21] Appl. No.: 715,625

[22] Filed: Aug. 18, 1976

[30] Foreign Application Priority Data

Sep. 5, 1975 [PH] Philippines ..... 17545

[51] Int. Cl.[2] ..... F15B 7/02

[52] U.S. Cl. ..... 60/539; 60/581; 60/594

[58] Field of Search ..... 60/539, 567, 581, 592, 60/594

[56] References Cited

U.S. PATENT DOCUMENTS

| | | | |
|---|---|---|---|
| Re. 26,628 | 7/1969 | Thompson | 60/539 |
| 2,426,695 | 9/1947 | Kremiller | 60/567 |
| 2,429,390 | 10/1947 | Case | 60/539 |
| 3,645,126 | 2/1972 | Kralowetz et al. | 60/581 X |

*Primary Examiner*—Edgar W. Geoghegan

[57] ABSTRACT

This hydraulic coupling and speed multiplying mechanism consists of an annular cylinder block having several rows of radial transmitting cylinders wherein are operatively disposed the corresponding radial pistons. The pistons in each circular row are uniformly spaced apart, while laterally adjacent pistons are angularly off-set relative to each other. Centrally disposed in said annular cylinder block is a cam assembly which actuates the pistons in one row simultaneously and the several rows sequentially. The transmitting cylinders in one row are interconnected and have a common pipeline. Two rows of transmitting cylinders are connected to a receiving cylinder a piston in which actuates a crankshaft to which may be connected any desired rotary device.

2 Claims, 6 Drawing Figures

HYDRAULIC COUPLING AND SPEED MULTIPLYING MECHANISM

DESCRIPTION OF THE INVENTION

This invention relates particularly to a hydraulic coupling and speed multiplying mechanism for transmitting rotary motion.

Rotary motion is transmitted usually by means of belts, chains, and gears or combination thereof. These means for transmitting rotary motion have, however, high transmission losses and are suitable only to a certain arrangement of the power transmitting shaft with the power receiving shaft.

The object, therefore, of this invention is to provide a mechanism for transmitting rotary motion which is capable of rotating a driven or receiving shaft faster and more powerfully than the speed and force of the driving transmitting shaft.

Another object is to provide a mechanism for transmitting rotary motion which is very simple and requires minimum maintenance.

Other objects, features and advantages of the present invention will become apparent after a study of the following detailed description of the accompanying drawings, in conjunction with the specification, wherein.

Figure 1:
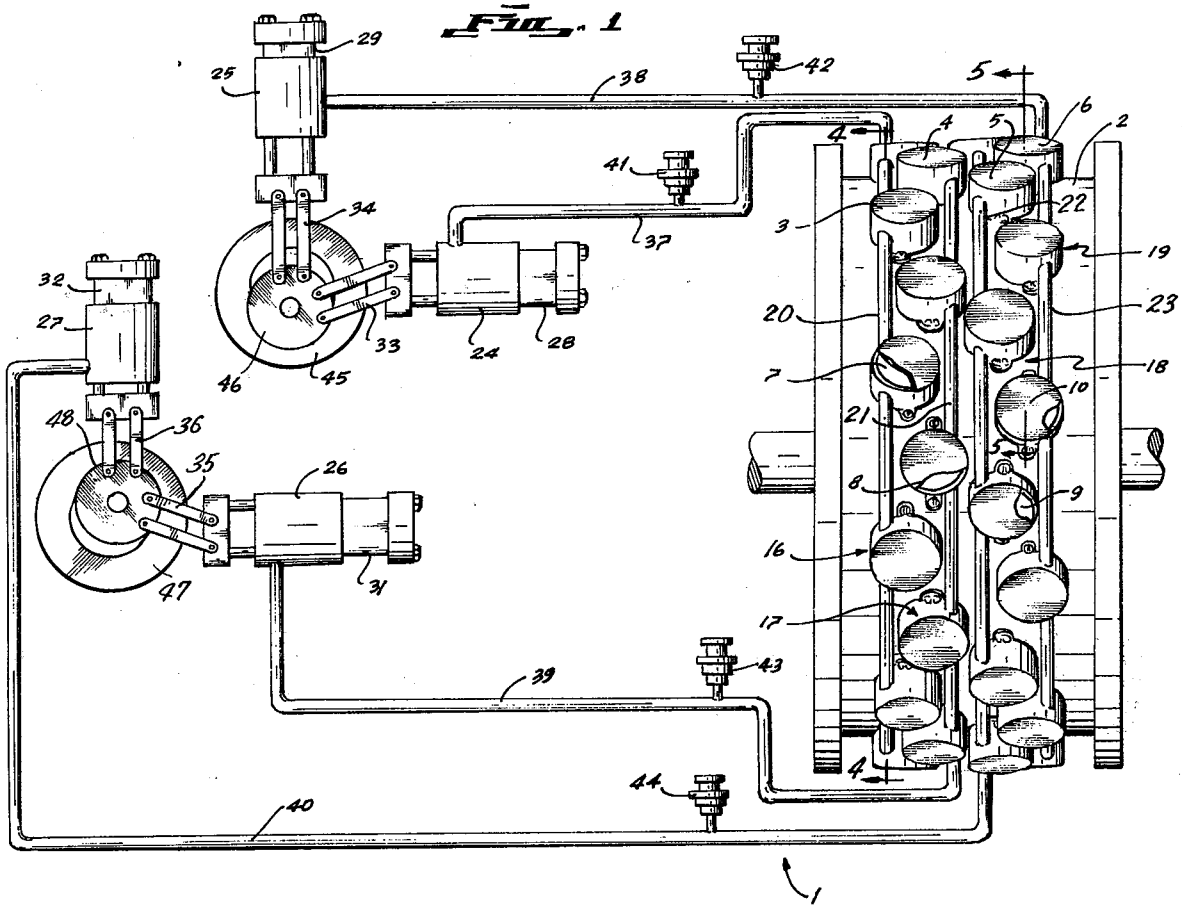
FIG. 1 is a schematic representation of a preferred embodiment of the hydraulic coupling and speed multiplying mechanism.
Figure 2:
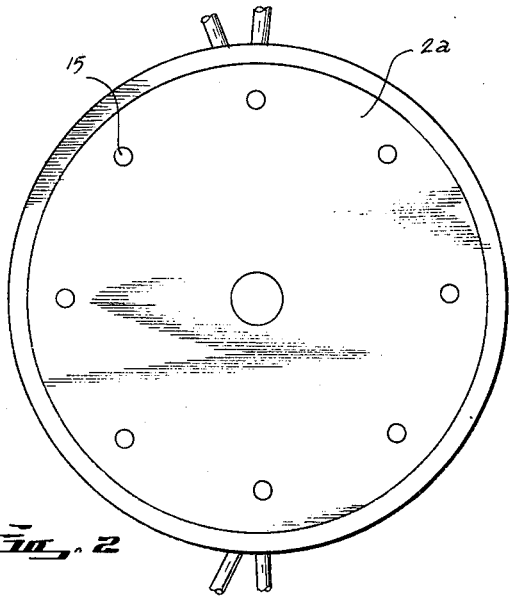
FIG. 2 is an end view of the annular cylinder block of the mechanism.
Figure 6:
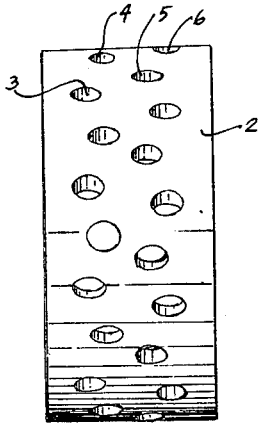
FIG. 6 is a side view of the annular cylinder block.

The hydraulic coupling and speed multiplying mechanism, as embodied in this invention, is shown in FIG. 1 and designated generally by the reference numeral 1. The complete mechanism as shown in FIGS. 1–6 includes an annular cylinder block 2 having four circular rows of identical transmitting hydraulic cylinders 3, 4, 5 and 6 and disposed therein respectively are rows of piston 7, 8, 9 and 10. As shown there are 10 cylinders in each circular row. The cylinders in each circular row are coplanar and are disposed radially at equal angular distances from each other. The corresponding pistons are directed to the axis of the casing with the rounded inner ends thereof substantially spaced from the axis of the annular cylinder block. The same relative positions therefore are also true in each of the rows of cylinders 3, 4, 5, and 6. However, laterally adjacent cylinders in the several circular rows are staggered, relative to each other as illustrated in FIG. 6. The axis of the laterally adjacent cylinders are therefore off-set by 9° from each other.

Figure 3:
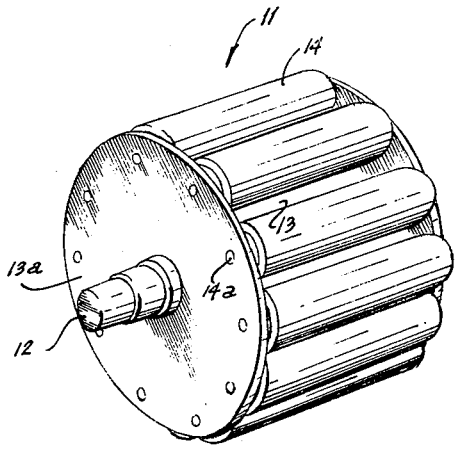
FIG. 3 is a perspective view of the cam assembly of this mechanism.

The annular cylinder block 2 has a central chamber **2*a* wherein is disposed the cylindrical cam assembly 11 which consists of a driving shaft 12, a solid core 13, two circular end plates 13*a* which are integral to the two ends of the core 13. As shown in FIG. 3, this cam assembly 11 has a plurality of small cylindrical rollers 14, the shafts ends 14*a* of which are secured at equal intervals near the peripheries of the plates 13*a*. Actually there are 10 rollers 14 and their surfaces are adapted to actuate or push the ends of the pistons of the transmitting hydraulic cylinders. The cam assembly 11 is positioned within the central chamber of the annular cylinder block by means of the cylinder end plates 2*a* which are secured to the opposed sides of the annular cylinder block 2 by means of the bolts 15. Rotation, therefore of the cam assembly 11** causes all the pistons to reciprocate within the cylinders, with all the pistons in each row reciprocating simultaneously.

The outer ends of the transmitting cylinders 3, 4, 5 and 6 are covered by corresponding cylinder head assemblies 16, 17, 18, and 19 respectively. The cylinder head assemblies 16, 17, 18 and 19 have corresponding inter connecting pipe lines 20, 21, 22 and 23 to provide fluid communication among the cylinders in the same row.

The mechanism has four receiving hydraulic cylinders 24, 25, 26 and 27 which are respectively provided inside with slidable pistons 28, 29, 31 and 32 which are capable of pulling respectively the links 33, 34, 35 and 36. These cylinders 24, 25, 26 and 27 are respectively connected to the connecting pipe lines 20, 21, 22 and 23 of the annular cylinder block 2, thru piplines 37, 38, 39 and 40 and tapped to those pipe lines respectively are the regulating hydraulic cylinders 41, 42, 43, and 44 for smoothing out pressure fluctuations. The driven cylinders 24 and 25 drive the crankshaft 45 through the pairs of links 33 and 34 which are connected thereto and to the stud 46 of said crankshaft. Similarly, the driven cylinders 26 and 27 drive the crankshaft 47 through the pairs of links 35 and 36 connected thereto and the stud 48 of said crankshaft.

Figure 4:
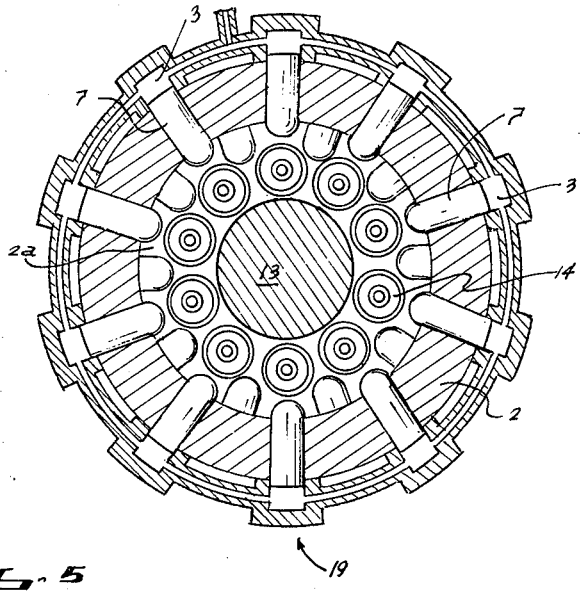
FIG. 4 is a cross-sectional view of the cylinder block taken generally along line 4—4 of FIG. 1.
Figure 5:
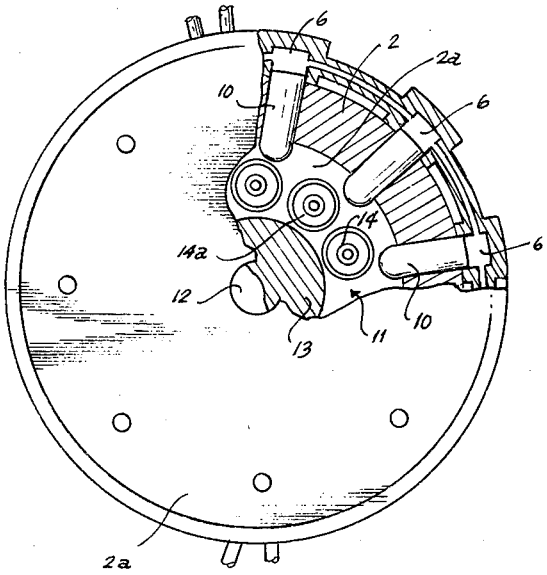
FIG. 5 is an end view of the cylinder block with a broken away portion to show a cross-section generally across line 5—5 of FIG. 1.

As illustrated in FIG. 4, the axis of the 10 cylinders in each circular row are angularly spaced by 36° so that whenever the cam assembly 11 turns a complete revolution the corresponding 10 pistons are simultaneously and repeatedly pushed in and out and the actions simultaneously actuate the fluid inside the corresponding pipe line actuating in and out ten times the piston in the corresponding receiving hydraulic cylinder. Similar and coordinated actions also take place in the other rows of cylinders and in their corresponding receiving hydraulic cylinders making therefore this mechanism an efficient means of multiplying the speed of the transmitted rotary motion.

While it will be apparent that the preferred embodiment of the invention disclosed is well designed to fulfill the objects mentioned, it will be understood that the invention is suceptable to modification, variation and change without departing from the scope of this invention.

I claim:

1. A hydraulic coupling and speed multiplying mechanism for transmitting rotary motion from a driving shaft to a driven shaft comprising an annular cylinder block, said annular cylinder block having therein several laterally spaced apart circularly arranged rows of radially disposed pressure transmitting cylinders, the pressure transmitting cylinder in each circular row, being uniformly spaced apart angularly and staggeredly arranged relative to each of the transmitting cylinders in the other circumferential rows; corresponding pistons operatively disposed in all said pressure transmitting cylinders; an interconnected cylinder head assembly secured to said annular cylinder block to cover the pressure transmitting cylinders in each circular row, a cam assembly with a driving shaft disposed within said cylinder block to actuate the pistons in each circular row simultaneously and sequentially relative to the pistons in said other circular rows, receiving hydraulic cylinders, operatively connected by corresponding pipe lines to said circular rows of pressure transmitting cylinders, each said receiving hydraulic cylinders having a corresponding piston with linkages, at least a pair of said receiving hydraulic cylinder pistons being connected to a common crankshaft, whereby upon rotation of the driving shaft of said cam assembly, said cam assembly actuates said pistons of said transmitting hydraulic cylinders causing the fluid in each said corresponding pipe lines to flow back and forth and causing also the pistons of said receiving hydraulic cylinders to reciprocate and rotate the crank shaft connected thereto faster than the rotation of said driving shaft.

2. A hydraulic coupling and speed multiplying mechanism for transmitting rotary motion of one shaft to another shaft as defined in claim 1, wherein said corresponding pipe lines of said pressure transmitting hydraulic cylinders and said pressure receiving hydraulic cylinder include regulating hydraulic cylinders to absorb any surging effect which may occur in said pipelines and which during operation maintain smooth and even rotation of said driven shaft.

* * * * *